United States Patent [19]

James

[11] Patent Number: 4,491,353

[45] Date of Patent: Jan. 1, 1985

[54] RECIPROCATORY DEVICES

[75] Inventor: Michael J. James, Cheltenham, England

[73] Assignee: Micro & Precision Mouldings (Cheltenham) Limited, Cheltenham, England

[21] Appl. No.: 490,299

[22] Filed: May 2, 1983

[30] Foreign Application Priority Data

May 11, 1982 [GB] United Kingdom ..... 8213592

[51] Int. Cl.[3] ..... E05C 19/02

[52] U.S. Cl. ..... 292/75; 292/DIG. 22; 292/DIG. 38; 292/DIG. 60; 292/DIG. 62

[58] Field of Search ..... 292/74, 75, DIG. 22, 292/DIG. 38, DIG. 44, DIG. 53, DIG. 60, DIG. 62

[56] References Cited

U.S. PATENT DOCUMENTS

| | | | |
|---|---|---|---|
| 1,154,439 | 9/1915 | Scholfield et al. | 292/DIG. 62 |
| 2,785,915 | 3/1957 | Daffurn et al. | 292/75 |
| 3,133,757 | 5/1964 | James | 292/75 |
| 3,322,450 | 5/1967 | Russell et al. | 292/75 |
| 3,430,399 | 3/1969 | James | 292/75 |
| 3,825,289 | 7/1974 | Armstrong | 292/DIG. 60 |

*Primary Examiner*—Richard E. Moore
*Assistant Examiner*—Thomas J. Dubnicka
*Attorney, Agent, or Firm*—Collard, Roe & Galgano

[57] ABSTRACT

A reciprocatory device in the form of a roller door catch has a reciprocatory plunger slidable in a fixed tubular housing and retained therein by an adjustment member. The plunger is urged to a normal resting position by a compression return spring. At its outer end the plunger rotatably supports a catch roller engageable with a recessed keeper mounted on the door frame. The adjustment member has a stem portion which projects into a blind bore at the inner end of the plunger, and this stem has radial stub projections which engage with a helical rib providing a screw thread within said bore, with a clearance in the axial direction approximating to the normal range of plunger reciprocation on door opening and closure. The adjustment member has a head portion with a frusto-conical clutch face which frictionally engages a mating clutch face at the inner end of the housing. The plunger is restrained against rotation within the housing, and a small amount of clutch slip as said clutch faces interengage on door opening provides an auto-set facility which compensates for variations in the gap between the door and the door frame at the shut face.

11 Claims, 12 Drawing Figures

RECIPROCATORY DEVICES

BACKGROUND OF THE INVENTION

1. Field of the Invention

This invention relates to reciprocatory devices, comprising a movable part which reciprocates relatively to a fixed part and which is associated with means to adjust the outward limit of the reciprocatory movement. The invention is of particular, but by no means exclusive, application to door catches in which case the movable part provides the catch member and the fixed part is the body of the catch which is fitted to the door.

2. Description of the Prior Art

The invention is applicable to roller door catches, which have a reciprocatory plunger part which projects from a door-mounted fixed housing part and carries a roller which engages a recessed keeper mounted on the adjacent door frame pillar. Such a catch has a return spring within the housing which urges the plunger to the outward limit of its reciprocatory movement, which is the normal resting position of the roller at which it engages a striker portion of the keeper on door closure. Adjustment means are commonly provided which provide for adjustment of this position to suit the gap between the edge of the door and the frame pillar, so that the outward projection of the roller can be appropriately set when the catch is fitted. However, with all the catches presently available subsequent adjustment to accommodate changes in said gap either requires that the catch should be removed from the door or else involves an otherwise complicated procedure, for example requiring that a thin screwdriver should be inserted through a diametral bore in the roller.

It has, however, been proposed in U.K. Pat. Nos. Nos. 1,098,721 and 1,180,553 to provide a reciprocatory device in the form of a roller door catch with automatic in-use adjustment of the outward reciprocatory limit so that, for example, day-to-day changes in the door edge gap due to shrinkage or expansion with changing atmospheric conditions are continually accommodated to ensure satisfactory catch operation at all times. This is referred to hereinafter as an "auto-set" facility, and according to such proposals this is achieved by an adjustment member which has clutch engagement with the catch housing and a limited range of reciprocatory movement with the catch plunger, beyond which further plunger movement is accommodated by rotational adjustment movement of that member. The clutch engagement limits the outward return movement of the member and plunger.

SUMMARY OF THE INVENTION

Although said prior proposals provide practicable constructions, for various reasons they have not reached the production stage and the object of the invention is to provide an improved arrangement with additional functional advantages, fewer component parts and reduced manufacturing cost generally.

Another object of the invention is to provide a reciprocatory device which enables the resting position of the reciprocatory part, for example the plunger of a roller door catch, to be set initially at the maximum outward adjustment limit by a simple manual operation, whereupon in use that part can automatically adjust inwardly to the correct outward limit position. This is referred to hereinafter as a "quick-set" facility.

It is to be appreciated that a device in accordance with the invention may provide either or both of said auto-set and quick-set facilities, although it is a particular advantage of the invention that it can readily provide both.

According to the invention means to adjust the outward limit of the reciprocatory part comprise an adjustment member which has screw-thread like engagement with the reciprocatory part and a clutch face which engages with a clutch face on, or fixed relatively to, the fixed part to define the outward limit of the reciprocation, and said screw-thread like engagement includes a degree of axial lost motion between the reciprocatory part and the adjustment member which approximates to the normal range of reciprocatory movement during use of the device, whilst axial stop means limit the inward movement of the adjustment member with the reciprocatory part.

Frictional clutch engagement is preferably employed, and frusto-conical clutch faces are generally to be preferred. However, if only the quick-set facility is required the clutch faces may be serrated or otherwise formed to provide a positive dog-like clutch engagement without slip and the the term "clutch face" is in a broad sense to be construed accordingly.

The screw-thread like engagement of the reciprocatory part and the adjustment member may be provided by a helical rib formed on one of these parts and engaged with appropriate axial clearance by a radial projection on the other. In this case the helical rib is preferably formed within an axial bore in the reciprocatory part and engaged by one or more radially projecting pegs on a stem of the adjustment member which projects into the bore. However, any equivalent arrangement can be employed such as spaced inclined flights on one part between which a projection on the other engages with clearance in the direction of the reciprocation axis.

The inward reciprocation of the adjustment member as the reciprocatory member moves inwardly may under normal circumstances be limited by an abutment shoulder or the like on the fixed member which for this purpose is engaged by an annular flange on the stem of the adjustment member. To provide the quick-set facility this flange may be movable beyond the abutment shoulder, by the application of a sufficient inward force to the reciprocatory part, to bring a second and larger flange on the stem into engagement with said shoulder which then engages between the flanges so that the member is "held-back" by the shoulder but can rotate as the spring returns the reciprocatory part to its fullest outward position whereupon the spring force is sufficient to spring the smaller flange past the shoulder to a normal operative position with engagement of the clutch faces.

The invention is of particularly advantageous application to a roller door catch, with the reciprocatory part provided by a spring-loaded plunger carrying the catch roller and the fixed part being a tubular catch housing with an outer end fixing flange. The normal range of reciprocation of the plunger is determined by the form of the recessed keeper engaged by the roller. All the parts of such a catch, excluding the return spring positioned within the housing, are desirably moulded from a plastics material such as nylon.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENT

Figure 8:
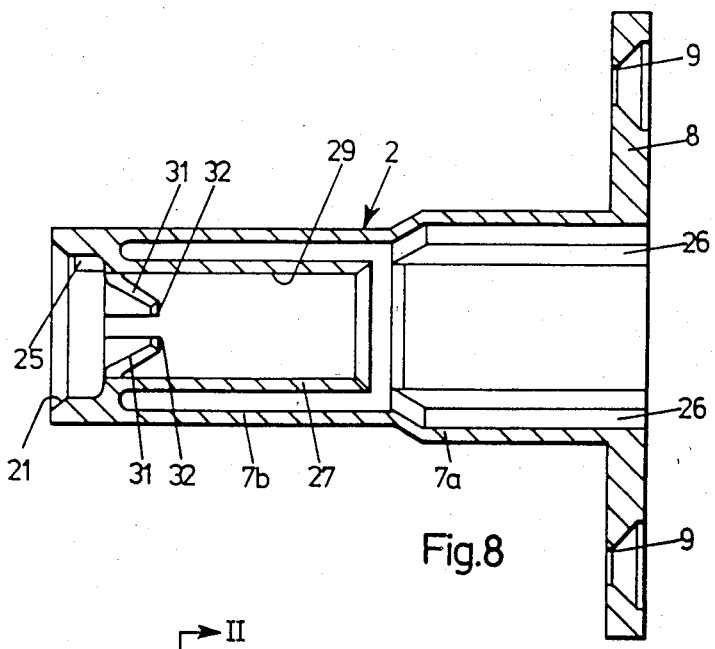
FIG. 8 is a sectional view on the line VIII—VIII in FIG. 6.
Figure 1:
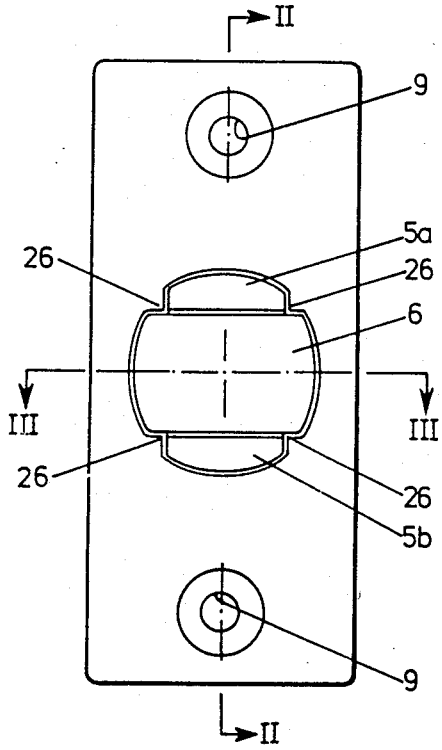
FIG. 1 is an outer end view of a roller door catch in accordance with the invention.

The door catch illustrated in the drawings provides a reciprocatory device in accordance with the invention having a reciprocatory plunger part 1 (FIG. 2) slidably received in a fixed housing part 2 and retained therein by an adjustment member 3. These three parts are all plastic molding, and a compression return spring 4 within the housing 2 urges the plunger 1 to a normal resting position (as illustrated) in which a forked outer end 5 projects from the housing 2. The catch roller 6 is rotatably mounted between the arms 5*a* and 5*b* of the forked end 5.

Figure 4:
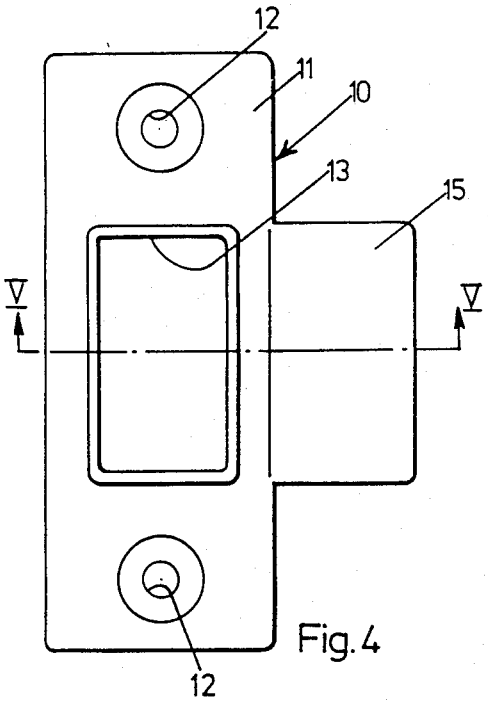
FIG. 4 is a face view of an associated keeper for engagement by the catch roller.
Figure 9:
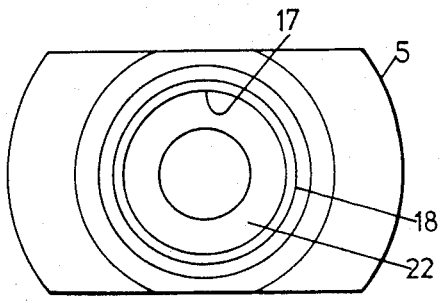
FIG. 9 is a detail inner end view of a plunger part of the catch, to a larger scale.
Figure 10:
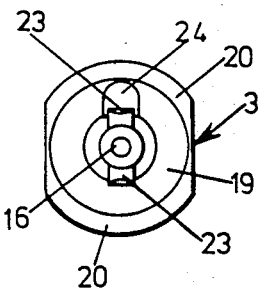
FIG. 10 is an outer end detail view of an adjustment member of the catch.
Figure 5:
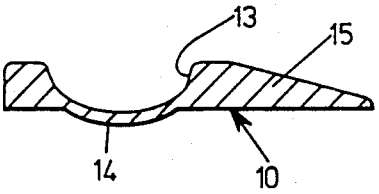
FIG. 5 is a sectional view on the line V—V in FIG. 4.

When fitted the housing 2 is recessed into the edge of the door in the usual manner, the housing comprising a stepped tubular portion 7 within which the plunger 1 slides and an outer end flange 8 with fixing screw holes 9. The keeper 10 (FIG. 4) is mounted opposite the catch on the adjacent door frame pillar and comprises a plate 11 with fixing screw holes 12. The plate 11 has a rectangular recess 13 in which the catch roller 6 engages to hold the door closed, and the keeper 10 is also a plastic molding with an integral ramp-like striker portion 15 at the side of the recess 13 and up which the roller 6 rides on door closure until it springs into the recess 13.

When the door is opened the plunger 1 is moved to its outward resting position, this outward limit of the reciprocatory movement which occurs each time the door is opened and closed being determined by engagement of the adjustment member 3 with the inner end of the housing 2. The member 3 has a stem portion 16 which engages in an axial blind bore 17 in a cylindrical stem portion 18 of the plunger 1, and a head portion 19 with a frusto-conical clutch face 20 which engages a mating clutch face 21 at the inner end of the tubular housing portion 7. The stem portion 16 has a screw-thread like engagement with the plunger 1, to this end a helical rib 22 within the bore 17 providing a thread which is engaged at positions 180° apart in the angular sense by two cylindrical stub projections 23 moulded on the stem portion 16. These projections 23 thus lie in spaced diametral planes the spacing of which is equal to the helical thread pitch, and as can be seen from FIG. 2 the diameter of the projections 23 is such as to provided clearance in the engaged inter-thread space so that there is a degree of axial lost motion between the plunger 1 and the adjustment member 3. This lost motion approximates to the normal range of reciprocation of the plunger 1 as a result of its engagement with the keeper 10.

At its root end adjoining the head 19 the stem 16 has a wing-like projection 24 which engages a stop projection 25 moulded within the housing 2, such engagement limiting the angular rotation of the member 3 to less than 360°. In fact, the projection 25 subtends an angle of 50° about the reciprocatory axis R and this, allowing for the thickness of the projection 24, limits the free rotation of the member 3 to about 300°. Rotation through this angle represents the full available range of plunger adjustment.

Figure 6:
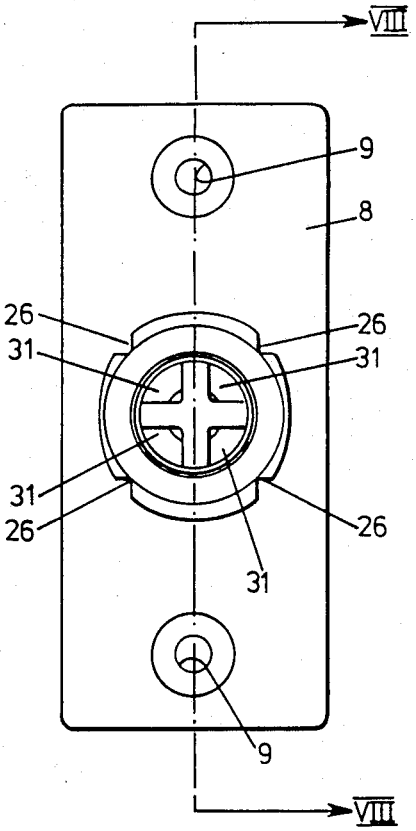
FIG. 6 is a detail outer end view of a fixed housing part of the catch.
Figure 7:
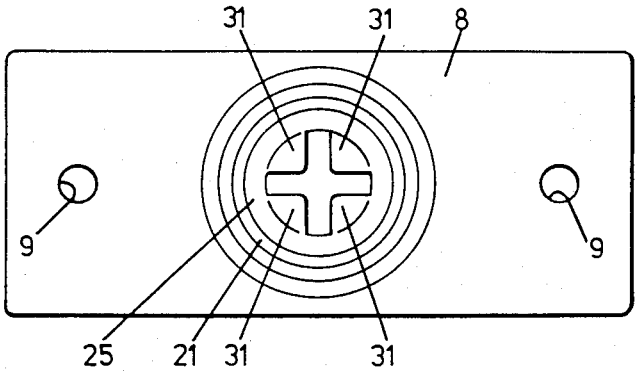
FIG. 7 is a corresponding inner end view.
Figure 11:
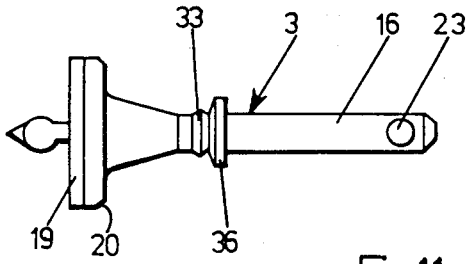
FIG. 11 is a side view thereof as seen from above in FIG. 10.

The plunger 1 is restrained against rotation about the axis R by four internal guide ribs 26 (FIG. 6) extending over an outer larger-diameter section 7*a* of the housing portion 7. These are symmetrically disposed with the two end limbs 5*a* and 5*b* of the plunger 1 respectively guided by the upper and lower pairs of the ribs 26. At its inner end the housing has a reduced diameter section 7*b* moulded with a re-entrant formation, providing an internal cylindrical projection 27 having two functions. In conjunction with the section 7*b* it provides an annular space 28 receiving and acting as a guide for the spring 4, whilst internally it provides a guide bore 29 for the plunger stem 18.

Figure 12:
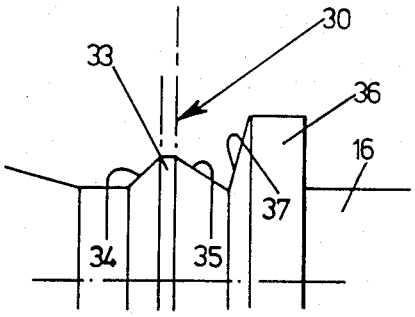
FIG. 12 is a fragmentary detail view of a part of FIG. 11 to a considerably larger scale.
Figure 2:
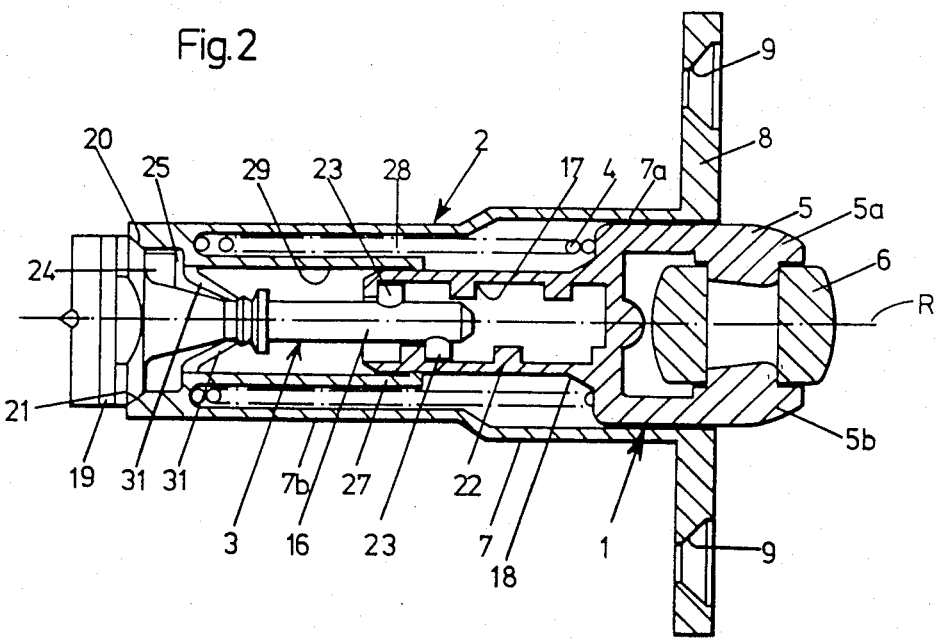
FIGS. 2 and 3 are respectively sectional views on the lines II—II and III—III in FIG. 1.
Figure 3:
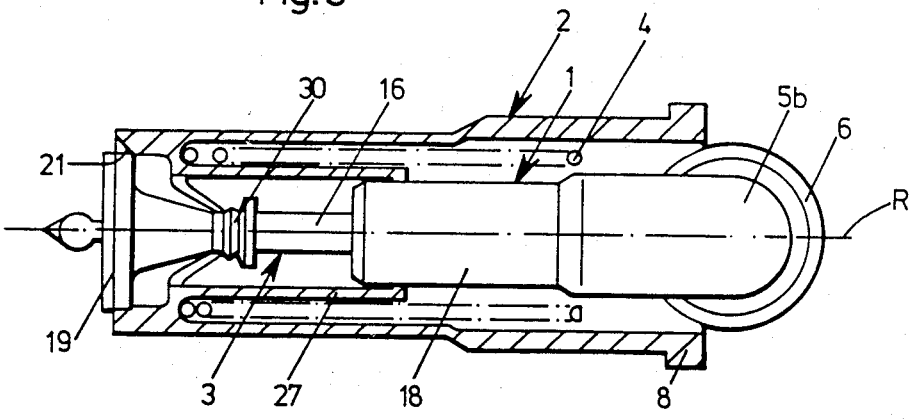

The stem 16 has an annular flange formation 30, shown in enlarged detail in FIG. 12, at an intermediate length position for cooperation with stop means limiting the inward movement of the member 3, that is to say movement to the left in FIG. 2. These stop means comprise a cuspid-like and internally projecting annular formation in the housing 2, split symmetrically into four segment-shaped parts 31, each presenting an outwardly facing stop shoulder 32. The flange formation 30 consists of a smaller flange 33 with inclined side faces 34 and 35, and a larger flange 36 with an inclined side face 37 which adjoins the face 35. With the member 3 seated against the inner end of the housing 2, the stop shoulders 32 are just clear of the flange side face 34 as can be seen from the sectional view of FIG. 2.

The significance of the various features described, and the manner in which they co-operate to satisfy the objects of the invention, will be made clear by the following functional description of the operation of the catch starting with the plunger 1 in the resting position illustrated in FIG. 2, i.e. with the door open. On door closure, engagement of the roller 6 with the striker ramp 15 results in inward movement of the plunger 1. After the lost motion represented by the clearance between the stubs 23 and the helical rib 22 has been taken up, further inward movement displaces the adjustment member 3 until the flange face 34 contacts the stop segments 31. If the plunger movement continues beyond this point, it is accommodated solely by rotation of the adjusting member 3 which is loosely held by the segments 31 with the stubs 23 sliding along the helical rib 22. As the roller drops into the recess 13 the adjustment member 3 moves outwardly with the plunger 1 after the lost motion has been taken up, and the depth of the recess 13 is such that the roller 6 seats in the recess 13 just as or slightly before the clutch faces 20 and 21 engage so that the spring 4 holds the roller 6 firmly in the keeper 10.

On door opening the same inward movement of the plunger 1 occurs, but after the roller 6 is clear of the striker portion 15 the plunger moves out a little bit further until the clutch faces are firmly in clutching engagement. As will be appreciated, such engagement initially involves a slight amount of clutch slip, with rotation of the adjustment member 3, such slip being an inherent characteristic of friction clutches. On door closure the cycle repeats itself and continual adjustment of the plunger occurs on each cycle, with a slight hunting movement of the outward limit of plunger movement. The outward limit, with the door open, is always such as to provide smooth catch operation with the roller 6 firmly seated in the recess 13 when the door is closed.

Any change in the door edge gap, due to atmospheric changes for example, are automatically compensated by adjustment of the outward limit of plunger movement to a correct position for smooth catch engagement. If the gap increases to the extent that said lost motion is not taken up, inward movement of the plunger will relieve the clutch engaging force and the adjustment on the outward return movement of the plunger 1 will be that which results from the clutch slip on clutch re-engagement. In other words there will always be that amount of adjustment per reciprocation, which will continue until the lost motion is completely taken up on inward plunger movement when inward adjustment will occur in the manner of the first cycle described. The extent to which the adjustment will "hunt" about the mean position, with the door edge gap remaining constant, will depend upon the difference between the lost motion and the engaged depth of the keeper recess 13.

During normal operation, as has been described, the smaller flange 33 provides the stop face 34 which engages the stop segments 31 to limit displacement of the member 3 with the plunger 1. However, the segments 31 are resiliently flexible such that if the plunger 1 is pushed firmly home into the housing 2 the stem 16 bottoms in the blind bore 17 and the flange 33 is sprung past the segments 31, which ride up the inclined face 34 with a camming action. The segments 31 now spring back to engage in a spring-clip like manner with the gap between the flanges 34 and 36 defined by the faces 35 and 37. The face 37 is more steeply inclined than face 34 and of greater diameter so that it provides a positive stop face which prevents further inward movement. If the plunger 1 is now released it springs outwardly to its maximum outward limit position, with the adjustment member held back so that it spins freely between the segments 31 until the wing 24 engages the stop 25. The spring force now overcomes the resilient grip of the segments 31 between the flanges 33 and 36 and the flange 33 is sprung back between the segments 31 to allow the normal clutch engagement.

Thus the flange formation 30 provides a quick-set facility by means of which the plunger 1 can very easily be set to its maximum outward position after the catch has been fitted to the door. Thereafter it can be correctly adjusted by the auto-set facility, merely by closing the door although if preferred it can be adjusted inwardly by an appropriate manual inward movement of the plunger which simulates the action of door closure.

I claim:

1. A reciprocatory device including a reciprocatory part which is reciprocable relatively to a fixed part, and means to adjust the outward limit of the reciprocatory part comprising an adjustment member which has screw-thread like engagement with the reciprocatory part and a clutch face which engages with a clutch face on, or fixed relatively to, the fixed part to define the outward limit of the reciprocation, wherein the reciprocatory part is restrained against rotation about the reciprocation axis relatively to the fixed part, said screw-thread like engagement includes a degree of axial lost motion between the reciprocatory part and the adjustment member which approximates to the normal range of reciprocatory movement during use of the device, and axial stop means limit the inward movement of the adjustment member with the reciprocatory part.

2. A reciprocatory device according to claim 1, wherein a return spring urges the reciprocatory part to said outward limit, at which the clutch face of the adjustment member engages the fixed clutch face.

3. A reciprocatory device according to claim 1, wherein frictional clutch interengagement of said clutch faces is employed.

4. A reciprocatory device according to claim 3, wherein the clutch faces are frusto-conical.

5. A reciprocatory device according to claim 1, wherein the clutch faces are formed to provide positive dog-like clutch interengagement of the clutch faces.

6. A reciprocatory device according to claim 1, wherein said screw-thread like engagement of the reciprocatory part and the adjustment member is provided by a helical rib formed on one of these parts and engaged with appropriate axial clearance by a radial projection on the other thereof.

7. A reciprocatory device according to claim 6, wherein the helical rib is formed within an axial bore in the reciprocatory part and this rib is engaged by one or more radially projecting pegs on a stem of the adjustment member which projects into the bore.

8. A reciprocatory device according to claim 1, wherein said screw-thread like engagement of the reciprocatory part with the adjustment member is provided by spaced inclined flights formed on one of these parts and between which a projection on the other thereof engages with clearance in the direction of the reciprocation axis.

9. A reciprocatory device according to claim 1, wherein the inward reciprocation of the adjustment member as the reciprocatory member moves inwardly is under normal circumstances limited by an abutment shoulder or the like on the fixed member which, for this purpose, is engaged by an annular flange on the stem of the adjustment member.

10. A reciprocatory device according to claim 9, wherein to provide a quick-set facility said annular flange is movable beyond the abutment shoulder, by the application of a sufficient inward force to the reciprocatory part, to bring a second and larger flange on said stem into engagement with said shoulder which then engages between the flanges so that the adjustment member is "held-back" by the shoulder but can rotate as the spring returns the reciprocatory part to its fullest outward position whereupon the spring force is sufficient to spring the smaller flange past the shoulder to a normal operative position allowing interengagement of the clutch faces.

11. A reciprocatory device according to claim 1 in the form of a roller door catch, said reciprocatory part being provided by a spring-loaded plunger rotatably supporting a catch roller and the fixed part being a tubular catch housing having an outer end fixing flange with the normal range of reciprocation of the plunger being determined by the form of an associated recessed keeper which is engaged by the catch roller.

* * * * *